US008759652B2

(12) United States Patent
Caprarola

(10) Patent No.: US 8,759,652 B2
(45) Date of Patent: Jun. 24, 2014

(54) REMOVABLE DRUM MUTE COVER

(76) Inventor: Teresa Elaine Caprarola, Westminster, MD (US)

( * ) Notice: Subject to any disclaimer, the term of this patent is extended or adjusted under 35 U.S.C. 154(b) by 254 days.

(21) Appl. No.: 13/413,650

(22) Filed: Mar. 6, 2012

(65) Prior Publication Data

US 2012/0227568 A1 Sep. 13, 2012

Related U.S. Application Data

(60) Provisional application No. 61/464,844, filed on Mar. 10, 2011.

(51) Int. Cl.
*G10D 13/02* (2006.01)

(52) U.S. Cl.
USPC ..... 84/411 M

(58) Field of Classification Search
USPC ..... 84/411 R, 411 M, 421
See application file for complete search history.

(56) References Cited

U.S. PATENT DOCUMENTS 6,586,664 B1 * 7/2003 Hubbell ..... 84/411 M

* cited by examiner

*Primary Examiner* — Kimberly Lockett

(57) ABSTRACT

A drum mute that is functional in both muting and covering a drum head. A circular cut of fabric with an elastic encased outer edge is made to be fitted over an entire drum head and rim, thereby providing a muted sound while allowing the drummer to retain full drumstick rebound. Various sizes, designs, and types of fabric can be used to construct the drum mute. A drawstring, tie, or other adhesiveless means of fastening can be used in place of elastic to fasten the drum mute fabric cover to a drum.

13 Claims, 2 Drawing Sheets

REMOVABLE DRUM MUTE COVER

RELATED APPLICATIONS

The present application is a continuation application of U.S. provisional patent application Ser. No. 61/464,844, filed Mar. 10, 2011, for DRUM MUTE, by Teresa Elaine Caprarola, included by reference herein and for which benefit of the priority date is hereby claimed.

FIELD OF THE INVENTION

The present invention relates to percussion or musical drum instrument and, more particularly, to a mute or muffler for a musical drum.

BACKGROUND OF THE INVENTION

Percussion drums are loud by design. There has always been a need to be able to practice and play drums in such a way that reduces the volume of sound so as to provide a quieter environment while playing. There is a need to maintain a realistic playing experience even while a drum is muted. I have found there is a need for a drum mute that allows full drumstick rebound while a drum is muted. I have found there is a need for a drum mute that can be quickly and easily attached, as well as quickly, easily, and completely removed. I have found there is a need for a drum mute to stay securely in place during play. I do not believe muting a drum should involve putting any type of adhesive on a drum. A drum mute should not take away from the appearance of a drum set. I believe muting a drum should not involve any disassembling of the drum.

There are several makers of drum mutes such as HQ Percussion Soundoff, Sound Percussion, and Vic Firth, that offer mutes made of a rubber/foam material constructed to sit on top of the drum head.

U.S. Pat. No. 4,899,635 is a drum mute that attaches using an adhesive on the drumhead.

U.S. Pat. No. 4,338,850 is a drum muffler that is situated within the drum.

U.S. Pat. No. 4,745,839 is a drum mute mounted inside the drum. U.S. Pat. No. 4,567,807 is a drum mute that requires adhering Velcro to the inside of a drum rim.

The specification for U.S. Pat. No. 5,561,254 says "A number of approaches have been implemented in the prior art to lessen ringing and restore a natural sound to drum sets. In some instances, drummers place a body of cloth or other similar material against a drum to deaden the drum head action." http://www.google.com/patents?printsec=abstract&zoom=4&id=gsslAAAAEBAJ&output=text&pg=PA3

There is a YouTube video that shows the use of t-shirts laid over drums to mute them. See http://www.youtube.com/watch?v=JDQGTyv2L5Q.

The rubber or foam type drum mutes such as the ones made by HQ Percussion, Sound Percussion, and Vic Firth, drastically reduce the amount of drumstick rebound. The rubber type drum mutes can move and bounce off while drumming.

A drum mute that is attached with adhesives, such as U.S. Pat. No. 4,899,635, can leave a sticky residue on the drumhead which can damage the drumhead and attract dirt.

Drum mutes that are mounted or situated within the drum such as U.S. Pat. Nos. 4,338,850 and 4,745,839 can be cumbersome and time consuming to attach, and are not easily removed.

Hook and loop type attachments such as Velcro attract dirt and debris when left on the drum as they are in U.S. Pat. No. 4,567,807.

T-shirts thrown over a drum, or simply placing a cloth on a drum, takes away from the aesthetics of a drumset. T-shirts and cloths laying over drums will bounce or slide off during drumming.

SUMMARY OF THE INVENTION

In accordance with the present invention, there is provided a removable drum mute cover for the purpose of muting and covering a percussion drum instrument, and a means for securely attaching a drum mute cover to the percussion drum instrument.

It would be advantageous to provide a drum mute that provides a quieter/muted sound during drum playing.

It would be advantageous to provide a drum mute that provides a level of protection from loud sound to the drummer and those around the drummer.

It would be advantageous to provide a drum mute that allows full drumstick rebound.

It would also be advantageous to provide a drum mute that offers a unique tone to a drum.

It would also be advantageous to provide a drum mute that stays securely in place during use.

It would further be advantageous to provide a drum mute that is quickly and easily applied.

It would further be advantageous to provide a drum mute that is quickly, easily and completely removable.

It would further be advantageous to provide a drum mute that would also serve as a protective cover to a drum.

It would be further advantageous to provide a drum mute that does not take away from the aesthetics of a drumset.

I would be further advantageous to provide a drum mute that did not require any disassembly of a drum.

BRIEF DESCRIPTION OF THE DRAWINGS

A complete understanding of the present invention may be obtained by reference to the accompanying drawings, when considered in conjunction with the subsequent, detailed description, in which.

For purposes of clarity and brevity, like elements and components will bear the same designations and numbering throughout the Figures.

DESCRIPTION OF THE PREFERRED EMBODIMENT

Figure 1:
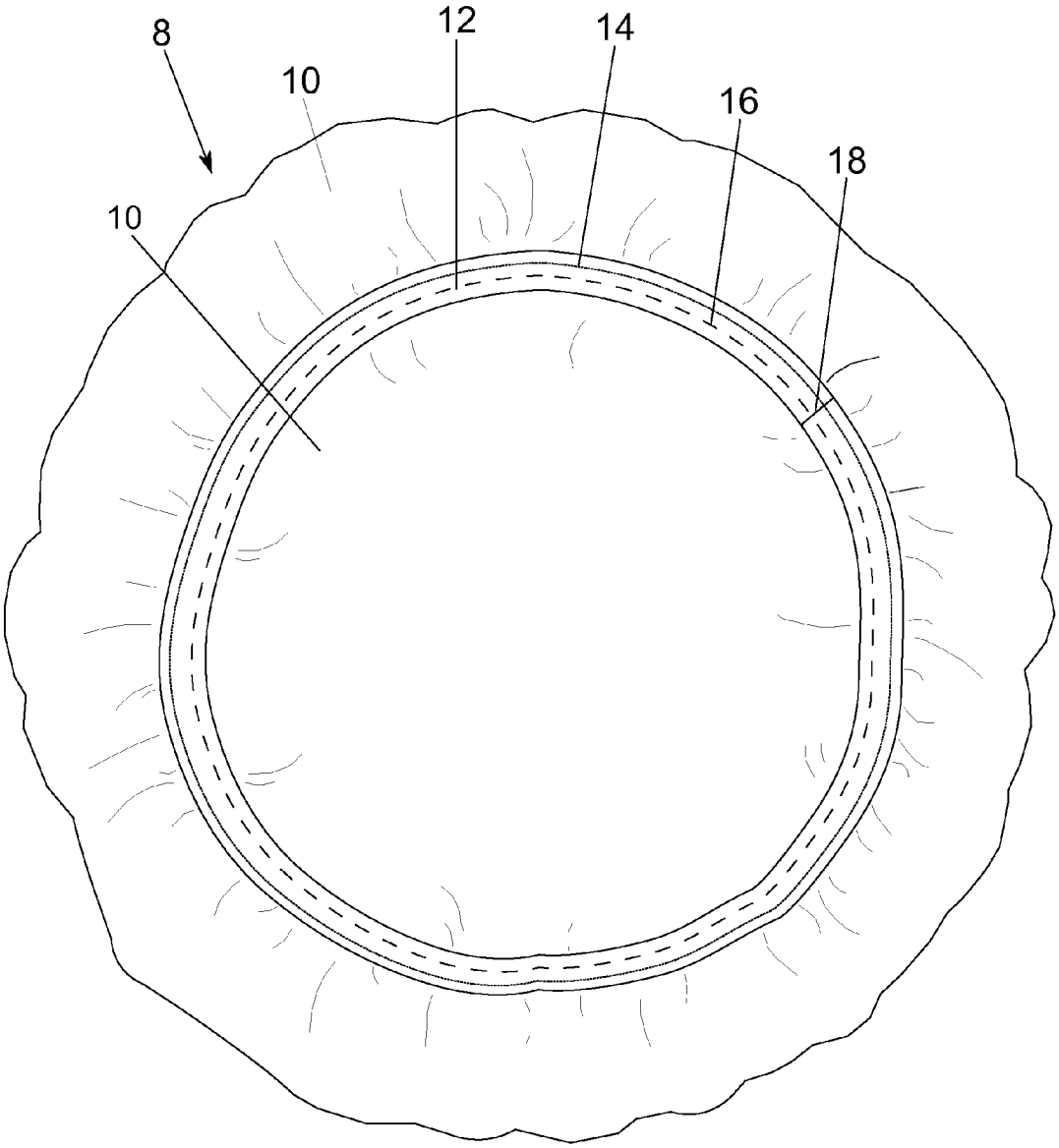
FIG. 1 is a bottom and inside perspective view of a percussion drum mute in accordance with the invention.

FIG. 1 is a bottom and inside perspective view of the inventive percussion drum mute 8 depicting the drum mute 8 from the bottom thereof when not placed on a drum. This embodiment is a fabric cover 10 with a casing 12 sewn onto the outer edge of the fabric. The casing 12 holds a fastener 16 that allows the fabric cover 10 to be placed securely and completely over a drumhead and rim. Other embodiments are satisfactory, but at present I believe that this embodiment works most efficiently if the cover 10 is made by using a single circular cut of fabric sized larger than the diameter of a rim, not shown.

A double fold bias tape works well as the casing 12 and is threadably sewn to the entire outer edge of the circular cut of fabric, creating a seam 14. You could allow a small excess of the double fold bias tape casing 12 in order to later create a finished end, shown as line 18.

Elastic material works well as the fastener 16. For this embodiment the elastic fastener 16 is sized shorter in length than the circumference of the drum to be fitted. The elastic fastener 16 is manually fed through the double fold bias tape casing 12 using a yarn needle (i.e. a blunt tipped, large eyed needle). The elastic is then tied off and seats entirely inside the casing 12. The excess allowance of double fold bias tape casing 12 is then folded under and threadably sewn down to create the finished end casing 12, shown as line 18. This embodiment is then placed securely over the entire head and rim of the percussion drum.

Figure 2:
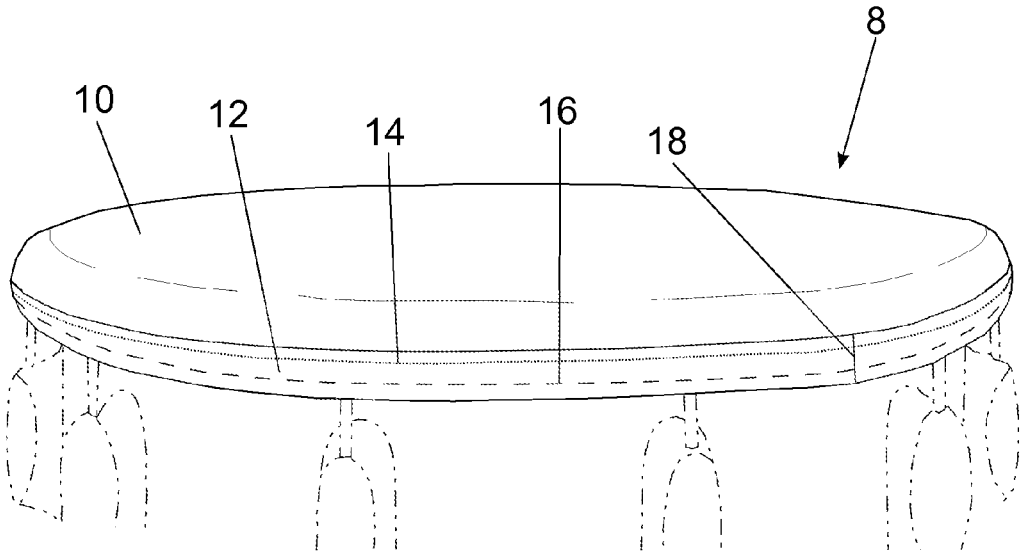
FIG. 2 is a top and side perspective view of a percussion drum mute in situ on a drum.

FIG. 2 is a top and side perspective view of the percussion drum mute 8 as it appears when in place on a drum. FIG. 2 shows how this embodiment covers the entire top head and rim of a percussion drum. FIG. 2 also shows the double fold bias tape casing 12 attached to the fabric cover 10 by a thread seam 14, with an elastic fastener 16 running through the casing 12.

Various fabrics can be used to construct the drum mute 8. Alternate adhesiveless means can be used to securely attach the drum mute 8 to the drum. This embodiment shows the elastic fastener 16 as encased, but the elastic fastener 16 can also be sewn directly to the edge of the fabric cover 10 without affecting the performance of the drum mute 8. A drawstring, not shown, can be fed through the casing 12 in place of elastic as another means of fastening. This embodiment can also serve as a protective cover 10 to protect a drum from the wear of play, as well as to protect a drum from dirt and debris.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A removable drum mute cover for the purpose of muting and covering a percussion drum instrument, comprising:

a fabric cover, having dimensions at least as great as dimensions of said percussion drum instrument head, for muting and covering the percussion drum instrument;

a secure fastener, for securely attaching said fabric cover to the exterior of the assembled percussion drum instrument with adhesiveless material.

2. The removable drum mute cover as recited in claim 1, further comprising:

a double fold bias tape casing, for providing a means for encasing a fastener, threadably connected to said cover, and manually inserted to said fastener.

3. The removable drum mute cover as recited in claim 1, further comprising:

a thread seam, for attaching a casing to the cover, threadably sewn to said casing.

4. The removable drum mute cover as recited in claim 2, further comprising:

a thread seam, for attaching a casing to the cover, threadably sewn to said casing.

5. The removable drum mute cover as recited in claim 1, wherein said cover has characteristics selected from the following group: polyester fabric, rayon fabric, Lycra spandex fabric, cotton fabric, wool fabric, silk fabric, satin fabric, nylon fabric, acrylic fabric, olefin fabric, ingeo fabric, linen fabric, ramie fabric, hemp fabric, flax fabric, bamboo fabric, and leather or any combination thereof.

6. The removable drum mute cover as recited in claim 1, wherein said fastener has characteristics selected from the following group: elastic material shorter in length than the circumference of the percussion drum to be fitted, and drawstring longer in length than the circumference of the drum to be fitted.

7. The removable drum mute cover as recited in claim 2, wherein said cover has characteristics selected from the following group: polyester fabric, rayon fabric, Lycra spandex fabric, cotton fabric, wool fabric, silk fabric, satin fabric, nylon fabric, acrylic fabric, olefin fabric, ingeo fabric, linen fabric, ramie fabric, hemp fabric, flax fabric, bamboo fabric, and leather or any combination thereof.

8. The removable drum mute cover as recited in claim 2, wherein said fastener has characteristics selected from the following group: elastic material shorter in length than the circumference of the percussion drum to be fitted, and drawstring longer in length than the circumference of the drum to be fitted.

9. The removable drum mute cover as recited in claim 3, wherein said cover has characteristics selected from the following group: polyester fabric, rayon fabric, lycra spandex fabric, cotton fabric, wool fabric, silk fabric, satin fabric, nylon fabric, acrylic fabric, olefin fabric, ingeo fabric, linen fabric, ramie fabric, hemp fabric, flax fabric, bamboo fabric, and leather or any combination thereof.

10. The removable drum mute cover as recited in claim 3, wherein said fastener has characteristics selected from the following group: elastic material shorter in length than the circumference of the percussion drum to be fitted, and drawstring longer in length than the circumference of the drum to be fitted.

11. The removable drum mute cover as recited in claim 4, wherein said cover has characteristics selected from the following group: polyester fabric, rayon fabric, lycra spandex fabric, cotton fabric, wool fabric, silk fabric, satin fabric, nylon fabric, acrylic fabric, olefin fabric, ingeo fabric, linen fabric, ramie fabric, hemp fabric, flax fabric, bamboo fabric, and leather or any combination thereof.

12. The removable drum mute cover as recited in claim 4, wherein said fastener has characteristics selected from the following group: elastic material shorter in length than the circumference of the percussion drum to be fitted, and drawstring longer in length than the circumference of the drum to be fitted.

13. A removable drum mute cover for the purpose of muting and covering a percussion drum instrument, comprising:

a double fold bias tape casing, for providing a means for encasing a fastener;

a fabric, polyester fabric, rayon fabric, Lycra spandex fabric, cotton fabric, wool fabric, silk fabric, satin fabric, nylon fabric, acrylic fabric, olefin fabric, ingeo fabric, linen fabric, ramie fabric, hemp fabric, flax fabric, bamboo fabric, leather or any combination thereof cover, for muting and covering said percussion drum instrument, threadably connected to said casing;

a thread seam, for attaching a casing to the cover, threadably sewn to said casing; and an elastic material shorter in length than the circumference of the percussion drum to be fitted, drawstring longer in length than the circumference of the drum to be fitted, secure fastener, for securely attaching said means for muting and covering to the percussion drum instrument with adhesiveless material, manually inserted to said casing.

* * * * *